United States Patent [19]

Tanizaki et al.

[11] 4,332,689

[45] Jun. 1, 1982

[54] WATER BASE LUBRICANT COMPOSITION

[75] Inventors: Yoshiharu Tanizaki, Yokohama; Shigeyuki Takase, Kawasaki; Kenichiro Minagawa, Yokohama; Kiyomitu Watanabe, Tokyo, all of Japan

[73] Assignee: Nippon Oil and Fats Co., Ltd., Tokyo, Japan

[21] Appl. No.: 136,578

[22] Filed: Apr. 1, 1980

[30] Foreign Application Priority Data

Sep. 28, 1979 [JP] Japan ..... 125017

[51] Int. Cl.[3] ..... C10M 1/06

[52] U.S. Cl. ..... 252/49.3; 72/42; 252/56 R; 252/56 S; 252/79

[58] Field of Search ..... 252/49.3, 56 R, 56 S, 252/79; 72/42

[56] References Cited

U.S. PATENT DOCUMENTS

| | | | |
|---|---|---|---|
| 3,374,171 | 3/1968 | Davis | 252/49.3 |
| 3,390,084 | 6/1968 | Lake | 252/49.3 |
| 3,959,534 | 5/1976 | Park et al. | 252/49.3 |
| 3,980,571 | 9/1976 | Marx | 252/49.3 |
| 4,146,488 | 3/1979 | Martin | 252/49.3 |

FOREIGN PATENT DOCUMENTS

| | | | |
|---|---|---|---|
| 52-899607 | 8/1977 | Japan | 252/56 R |
| 53-935059 | 5/1978 | Japan | 252/56 R |

*Primary Examiner*—Curtis R. Davis

*Attorney, Agent, or Firm*—Blanchard, Flynn, Thiel, Boutell & Tanis

[57] ABSTRACT

A polymer of polyoxyalkylene glycol monoacrylate or polyoxyalkylene glycol monomethacrylate is very useful as a base of lubricants.

5 Claims, No Drawings

WATER BASE LUBRICANT COMPOSITION

BACKGROUND OF THE INVENTION

Field of the Invention

This invention relates to water base lubricant compositions and more particularly relates to water base lubricant compositions which are low in foamability and are useful in a water soluble hydraulic fluid, a heat medium and a metal working fluid.

Heretofore, non-aqueous combustible lubricants whose bases are mineral oil or animal and plant oils, have been used for a hydraulic fluid, a heat medium, a metal working fluid and the like.

Recently, water base lubricants have been adopted in place of the non-aqueous combustible lubricants for the purpose of preventing fires which occur due to the leakage thereof and for the reason that when they are used for a metal working fluid, the treated lubricants are easily washed off from the metal surface.

As the water base lubricants, there are used, in general, water soluble compounds of high molecular weight for upgrading the lubricity and for increasing the viscosity thereof.

As the water base lubricants, there are known polyvinyl alcohol, salts of polymethacrylic acid, cellulose derivatives, polyoxyalkylene compounds and the like.

Especially, the polyoxyalkylene compounds have advantages in that they have low pour points for use as a synthetic lubricant, they are splendid in viscosity characteristics, they form a small quantity of sludge and varnish and they do not corrode sealing materials of all kinds such as metals, rubber and the like.

However, the known polyoxyalkylene compounds have disadvantages in that they are bad in oxidation stability at an elevated temperature, are apt to undergo thermal decomposition and are bad in lubricity because of their poor wetting on a metal surface, and they generate a large amount of foam.

SUMMARY OF THE INVENTION

It is an object of the present invention to provide a water base lubricant composition which is splendid in lubricity and is low in foamability.

It is an another object of the present invention to provide a water base lubricant composition which is splendid for increasing viscosity and which forms low amounts of sludge.

It is a further another object of the invention to provide a water base lubricant composition which is low in corroding metals.

The present invention is based on the knowledge that a polymer of polyoxyalkylene glycol monoacrylate or polyoxyalkylene glycol monomethacrylate is very useful as a base of a lubricant.

A water base lubricant composition of the present invention comprises 4–80 parts by weight of polymers of polyoxyalkylene glycol monoacrylate or polyoxyalkylene glycol monomethacrylate (hereinafter both are collectively called PAGMA) and 20–96 parts by weight of water. If necessary, 0–50 parts by weight of a water soluble organic solvent may be added to the water series lubricant of the present invention.

The polymer of PAGMA of the present invention comprises repeating units having the following formula (1) whose number average molecular weight is less than 100,000:

$$-CH_2-\underset{\underset{COO\,(C_mH_{2m}O)_nH}{|}}{\overset{\overset{R}{|}}{C}}- \qquad (1)$$

wherein R is H or $CH_3$, m is an integer of 2–4 and n is an integer of 2–20.

The polymer of the present invention comprising repeating units of the formula (1) is obtained by polymerizing PAGMA which is shown in the formula (II):

$$CH_2{=}\overset{\overset{R}{|}}{C}COO\,(C_m\,H_{2m}\,O)_nH \qquad (II)$$

wherein R is H or $CH_3$, m is an integer of 2–4 and n is an integer of 2–20.

PAGMA of the formula (1) may be obtained by subjecting hydroxyalkyl monoacrylate or hydroxyalkyl monomethacrylate to an addition polymerization with ethylene oxide, propylene oxide, butylene oxide or tetrahydrofuran according to the processes which are shown in Japanese Pat. Nos. 899607 and 935059.

The homopolymerization of PAGMA for obtaining the polymers of the present invention is carried out at a temperature of 40°–180° C., preferably 60°–150° C., for 0.5–30 hours, preferably 1–20 hours in an organic solvent using a polymerization initiator.

Because the starting material of PAGMA contains an extremely small quantity of di(meth)acrylate compound, which is a byproduct in the production thereof and in the polymerization, the three dimensional combination occurs, whereby the obtained polymer undergoes gelation to cause it to be nonuniform, it is better for obtaining a uniform polymerization solution to employ a transfer agent.

As for the organic solvents, there are mentioned, methanol, ethanol, n-propanol, isopropanol, n-butanol, sec-butanol, ethylene glycol, monoethyl ether, ethylene glycol monobutyl ether, dimethyl formamide, dimethylsulfoxide, acetonitrile, acetone, methyl ethyl ketone and the like. The organic solvent is used in an amount of 10–5000 parts, preferably 50–2000 parts by weight based on 100 parts by weight of PAGMA used.

As for the polymerization initiator, there are shown benzoyl peroxide, methylethyl ketone peroxide, cumene hydroperoxide, di-t-butyl peroxide, iso-butyroyl peroxide, t-butylperoxyoctanate, dicumyl peroxide, azobisisobutyronitrile and the like.

The said polymerization initiators are used in an amount of 0.01–25 parts, preferably 0.05–15 parts by weight based on the PAGMA used.

As the transfer agents which are usable for the polymerization there are mentioned mercaptans such as dodecylmercaptan and octylmercaptan, and disulfides such as bis-(hydroxyethyl)disulfide, bis-(2-ethylhexyl)-disulfide, thioglycolic acid.

The said transfer agents are used in an amount of 0.5–50 parts by weight based on 100 parts by weight of the PAGMA used.

The polymer of the PAGMA is less than 100,000, preferably 1,000–50,000, in number average molecular weight. The polymer of the PAGMA whose number average molecular weight exceeds 100,000, is poor in the solubility in the solvents.

The polymer of PAGMA may dissolve very well into water, alcohols, glycols and other organic solvents. When some of the PAGMA are insoluble in water, they may be made into an aqueous solution thereof using a solvent which is soluble in water.

As for the above mentioned solvents, there are mentioned lower monohydric alcohols such as methanol, ethanol, propanol and the like, glycols such as ethylene glycol, diethylene glycol, propylene glycol, dipropylene glycol and the like, glycol ethers such as ethyleneglycol monomethylether, ethyleneglycol monomethylether, diethyleneglycol monoethylether, ethyleneglycol monobutylether, diethyleneglycol monobutylether, propyleneglycol monomethylether, dipropyleneglycol monomethylether, propyleneglycol monoethylether, dipropyleneglycol monoethylether, propyleneglycol monobutylether, dipropyleneglycol monobutylether and the like, derivatives of polyoxyalkylene glycol such as polyoxyethylene glycol, polyoxypropylene glycol, polyoxyethyleneoxypropylene glycol and the like, and organic solvents such as dimethylformamide, dimethylsulfoxide, acetonitrile, acetone, methyl ethyl ketone, tetrahydrofuran and the like.

If necessary, additives such as an antiwear agent, a rust inhibitor, an antioxidant, an antifoaming agent and the like may be mixed with the water series lubricant to upgrade the properties thereof for lubricant purposes.

As for the antiwear agent, there are mentioned sodium-, potassium-, or amine soap of aliphatic or aromatic carboxylic acid, fatty acid ester, fatty acid amide, phosphoric acid ester of phenols, or higher alcohols, and the like.

Illustrative of the rust inhibitors are sodium mercapto benzotriazole, sodium phosphate, potassium phosphate, sodium and potassium salts of phosphoric acid, nitrite, morpholine and the like.

As the antioxidant, hindered phenol compounds, bisphenol compounds, aromatic amines and the like are mentioned. As the antifoaming agents, there are mentioned silicone series compounds.

The polymers of PAGMA are very effective as a lubricant and they are more particularly effective as a base fluid of a water-glycol-system fire resistant hydraulic fluid and a water soluble metalworking fluid. Further, they are very useful as an antistatic agent, a dying assistant, and a spinning oil for chemical fibers such as polyester, nylon, acrylic fiber, rayon, acetate fiber and the like, and natural fibers such as wool, cotton, silk and the like.

They are also suitable for a cosmetic fluid because they also promptly dissolve into a water-alcohol system solvent and they do not change in quality at a broad range of temperature and PH value of a PAGMA solution.

PREFERRED EMBODIMENTS OF THE INVENTION

The term "part" and "%" small mean part by weight and % by weight respectively hereinafter.

Preparation of polymer of polyoxyethyleneglycol monomethacrylate (called as PEMP-1)

Into a reaction vessel which was equipped with a stirrer, a reflux condenser and a thermometer, there was charged 80 parts of isopropanol which was heated to 80° C. 20 parts of polyoxyethyleneglycol methacrylate (product of Nippon Oil and Fats Co., Ltd., Trade Mark: Blemmer PE-350) whose number average molecular weight was 425 and into which 0.4 part of benzoyl peroxide (BPO), as a catalyst, was dissolved, were dropped into the reaction vessel for 2½ hours, thereby carrying out a polymerization.

Further, 0.4 part of BPO which was dissolved into 3.8 parts of methyl ethyl ketone, was added to the contents of the reaction vessel, followed by aging the same for 5 hours. The resulting polymer was cooled to room temperature and was poured into 1500 parts of ethyl ether, thereby forming a mixture.

The obtained precipitate in the lower layer were heated at a reduced pressure of 30 mm Hg and at 40° C. for 2.0 hours to remove ethyl ether, whereby 16.6 parts of polymer of purified polyoxyethyleneglycol monomethacrylate (conversion ratio:83.1% PEMP-1), which was recognized by the infrared spectrum, the nuclear magnetic resonsance spectrum and the Gel permeation chromatograph thereof.

Preparation of polymer of polyoxyethyleneglycol monoacrylate (called as PEAP-2)

Into the same reaction vessel was used in the preparation of PEMP-1, there was charged 50 parts of isopropanol and 1.5 parts of dodecylmercaptan as a transfer agent. Further, 50 parts of polyoxyethylene glycol monoacrylate whose number average molecular weight was 418 and into which 0.5 part of BPO was dissolved, were dropped into the reaction vessel at 83° C. for one hour, followed by aging the contents of the reaction vessel for 5 hours.

The obtained polymer was precipitated by adding 2000 parts of ethyl ether thereto, followed by heating the same at a reduced pressure to remove the ethyl ether remaining therein, whereby 36 parts of polymers of polyoxyethyleneglycol monoacrylate was obtained.

Preparation of polymer of polyoxyethylene glycol monomethacrylate (called as PEMP-3)

According to the same procedures as described in the preparation of PEMP-1, 60 parts of isopropanol and 2 parts of thioglycolic acid was charged into the reaction vessel and 40 parts of polyoxyethylene glycol monomethacrylate whose number average molecular weight was 288 and into which 0.5 part of BPO was dissolved, were dropped into the reaction vessel.

The resulting mixture was aged for 5 hours. The obtained polymer was precipitated by adding 2000 parts of ethyl ether, followed by eliminating the ethyl ether remaining in the polymer at a reduced pressure, whereby 31 parts of polymer of purified polyoxyethylene glycol monomethacrylate was obtained.

(conversion ratio: 72.0%).

Preparation of polymer of polyoxyethylenepropylene glycol monomethacrylate (called as PEMP-4)

According to the same procedures as described in the preparation of PEMP-1, 20 parts of polyoxyethylenepropylene glycol monomethacrylate whose number molecular weight was 431 and whose mixing ratio of oxyethylene to oxypropylene was 50:50 and wherein 0.5 part of BPO was dissolved, were dropped into 80 parts of secondary butanol for 1½ hours to react, and the resulting reaction product was aged for 5 hours.

The obtained polymer was precipitated by adding 1800 parts of ethyl ether, followed by heating the same at a reduced pressure to remove the ethyl ether therefrom, whereby 15.6 parts of polymer of polyoxyethylenepropylene glycol monomethacrylate was obtained.

Preparation of polymer of polyoxypropylene glycol monomethacrylate (called as PEMP-5)

According to the same procedures as described in the preparation of PEMP-1, 20 parts of polyoxypropylene glycol monomethacrylate (Nippon Oil and Fats Co., Ltd., Trade Mark Blemmer PP-1000) whose number average molecular weight was 371 and wherein 0.4 part of BPO was dissolved, were dropped into 30 parts of isopropanol for one hour to react, and the resulting product was aged for 6 hours. The obtained polymer was precipitated by adding 1200 parts of n-hexane followed by heating the same at a reduced pressure to remove the n-hexane therefrom, whereby 17.6 parts of polymer of polyoxypropylene glycol monomethacrylate were obtained.

The respective polymers obtained in preparations 1–5, were examined about their respective solubilities to ethanol, tetrahydrofuran and water. Further, gel permeation chromatography analysis was applied to the respective tetrahydrofuran solutions, whereby the respective number average molecular weight and weight average molecular weights were obtained.

The obtained results are shown in Table 1.

TABLE 1

| | Solubility* | | | Average molecular weight | |
|---|---|---|---|---|---|
| Polymer | Ethanol | Tetrahydro-furan | Water | Number average | Weight average |
| PEMP-1 | ○ | ○ | ○ | 23,900 | 37,100 |
| PEMP-2 | ○ | ○ | ○ | 16,200 | 24,000 |
| PEMP-3 | ○ | ○ | ○ | 6,100 | 9,300 |
| PEMP-4 | ○ | ○ | ○ | 24,100 | 39,400 |
| PEMP-5 | ○ | ○ | Δ | 20,700 | 31,500 |

Note:
*Solubility is that obtained at room temperature Mark ○ shows that a sample dissolves into a solvent uniformly
Mark Δ shows that a sample dissolves into 30% ethanol aqueous solution but does not dissolve into water

EXAMPLES 1 AND 8, COMPARATIVE EXAMPLES 1 AND 2

Respective water base lubricant compositions were prepared by mixing respective bases with the balance of the compositions in the mixing ratio set forth in Table 2. The balance of the compositions had the following recipe.

| The balance of the compositions excluding the base | Parts by weight |
|---|---|
| Water (ion exchanged water) | 43.8 |
| Ethylene glycol (solvent) | 46.1 |
| Oleic acid | 6.9 |
| Morpholine | 1.2 |
| Potassium hydroxide | 1.7 |
| Benzotriazole | 0.24 |
| Silicone compound | 0.06 |

The respective water base lubricants were measured for their kinetic viscosity, viscosity index, pour point and foaming property.

Further, they were examined for their lubricity by a Four ball tester (Soda method) and for their maximum load and unit load thereof by a Timken machine tester.

As comparative examples in relation to the present invention, water series lubricants were prepared by mixing with the balance composition excluding the base, as used in Examples 1–8; polyoxyethylenepropylene glycol and polyethylene glycol in place of the polymers used in Examples 1–8.

The obtained comparative water base lubricants (Comparative Examples 1 and 2) were examined for their properties according to the same procedures as those in Examples 1–8.

The obtained results are shown in Table 2.

Additional tests were performed as follows:

Stability to oxidation and corrosiveness to metals of the water base lubricant.

The water base lubricants of Example 1, Example 3, Example 5, Example 7, and Comparative Example 1 were examined for their respective properties of oxidation stability and corrosiveness to metals, according to Japanese Industrial Standard Method K-2234 for testing an unfreezing liquid.

Respective sample liquids taken were 350 ml, in volume, the examination was carried out at 70° C., blowing 100 ml/min of air into the sample liquid for 2 weeks. The obtained results are shown in Table 3.

Stability to oxidation of a water series lubricant was judged from the kinetic viscosity and PH change thereof after the examination. From Table 3, it was recognized that the water series lubricants of the present invention were superior to the comparative examples in oxidation stability and corrosiveness to metals.

Tests for working fluid properties of water base lubricant.

TABLE 2

| | Polymer | Mixing ratio of a base to the balance | Kinetic viscosity 40° C. (Cst) | Viscosity index VIE | Pour point (°C.) | Foaming property 0 min | Foaming property after 10 min | Four ball test by Soda method 220rpm (kg/cm²) | Oil test by Timken method Maximum load (lbs) | Oil test by Timken method Unit load (psi) |
|---|---|---|---|---|---|---|---|---|---|---|
| Example 1 | PEMP-1 | 9.3 | 42.0 | 189 | −47.5 | 45 | 0 | 9.0 | 40 | 23.700 |
| Example 2 | PEMP-1 | 14.2 | 53.4 | 191 | −47.5 | 48 | 0 | 9.5 | 44 | 28.500 |
| Example 3 | PEMP-2 | 9.8 | 42.1 | 187 | −50.0 | 39 | 0 | 9.0 | 42 | 30.800 |
| Example 4 | PEMP-2 | 14.0 | 49.8 | 190 | −47.5 | 42 | 0 | 10.0 | 46 | 31.500 |
| Example 5 | PEMP-3 | 13.8 | 42.2 | 191 | −52.5 | 27 | 0 | 10.5 | 47 | 31.700 |
| Example 6 | PEMP-3 | 18.4 | 53.1 | 193 | −50.0 | 35 | 0 | 11.5 | 49 | 32.200 |
| Example 7 | PEMP-4 | 9.1 | 42.3 | 188 | −55.0 | 51 | 0 | 9.0 | 43 | 28.500 |
| Example 8 | PEMP-4 | 14.0 | 54.7 | 192 | −52.0 | 53 | 0 | 9.5 | 45 | 30.700 |
| Comparative Example 1 | Polyoxyethylene propylene glycol | 14.3 | 42.1 | 185 | −45.0 | 80 | 0 | 8.5 | 36 | 18.400 |
| Comparative Example 2 | Polyethylene | 10.1 | 41.9 | 187 | −37.5 | 165 | 10 | 7.5 | 34 | 15.100 |

TABLE 2-continued

| Polymer | Mixing ratio of a base to the balance | Kinetic viscosity 40° C. (Cst) | Viscosity index VIE | Pour point (°C.) | Foaming property 0 min | Foaming property after 10 min | Four ball test by Soda method 220rpm (kg/cm²) | Oil test by Timken method Maximum load (lbs) | Oil test by Timken method Unit load (psi) |
|---|---|---|---|---|---|---|---|---|---|
| glycol | | | | | | | | | |

TABLE 3

| | Polymer | Oxidation Stability Viscosity Cst(40° C.) | PH | Corrosion to Metal (mm/cm²) Alminium | Iron | Steel | Brass | Solder | Copper |
|---|---|---|---|---|---|---|---|---|---|
| Example 1 | PEMP-1 | Before test 42.0 | 10.9 | −0.071 | −0.037 | −0.018 | −0.102 | −0.073 | −0.061 |
| | | After test 39.1 | 7.3 | | | | | | |
| Example 3 | PEMP-2 | Before test 42.1 | 10.7 | −0.065 | −0.025 | −0.027 | −0.233 | −0.064 | −0.057 |
| | | After test 39.1 | 7.2 | | | | | | |
| Example 5 | PEMP-3 | Before test 42.2 | 11.1 | −0.039 | −0.015 | −0.031 | −0.097 | −0.135 | −0.195 |
| | | After test 39.5 | 7.8 | | | | | | |
| Example 7 | PEMP-4 | Before test 42.3 | 11.2 | −0.053 | −0.042 | −0.012 | −0.084 | −0.181 | −0.088 |
| | | After test 38.4 | 6.9 | | | | | | |
| Comparative Example 1 | Polyoxylthylene propylene glycol | Before test 42.1 | 11.0 | −0.214 | −0.043 | −0.043 | −0.521 | −0.273 | −0.409 |
| | | After test 37.1 | 5.7 | | | | | | |

Test for working fluid properties of water base lubricants were carried out for the water base lubricants of Example 1, 5, 7 and Comparative Example 1, using a Vein pump which was a oil pressure pump of Vickers Co., Ltd. under the following conditions.

| | |
|---|---|
| amount of sample taken: | 80l |
| discharge pressure: | 70kg/cm² |
| rpm of pump: | 1200 |
| entrance temperature of pump: | 55° C. |
| testing hours: | 100 hours |

The obtained results are shown in Table 4.

TABLE 4

| Polymer | Metal wear amount of pump (mg) Cume ring | Vein | Total | Conditions of working fluid Occurrence of sludge | Appearance |
|---|---|---|---|---|---|
| Example 1 | Pemp-1 | 192.6 | 24.8 | 217.4 | none | transparent |
| Example 5 | PEMP 3 | 143.6 | 11.3 | 154.9 | none | transparent |
| Example 7 | PEMP-4 | 146.2 | 37.5 | 183.7 | none | transparent |
| Comparative Example 1 | Polyoxyethylene propylene-glycol | 794.6 | 43.9 | 838.5 | none | a little cloudy |

It was recognized from Table 4 that the water base lubricants of the present invention are superior to the Comparative example as a working fluid for the reason that the former are transparent and cause less metal wear amount of the pump than the latter and there is no occurrence of sludge in the former.

As described in the foregoing, the water base lubricant of the present invention is superior to the known polyoxyalkylene glycol compounds in increasing the viscosity thereof and in the lubricity and they are low in foam and are fluid at low temperature.

Accordingly, the water base lubricants of the present invention are very effective for use as a water series lubricant, a water-glycol base fire-resistance hydraulic fluid, a metal molding oil, a cutting or grinding oil and a base or additive for a water base quenching oil.

The embodiments of the invention in which an exclusive property or privilege is claimed are defined as follows:

1. A water-based lubricant comprising a solution of from 20 to 96 parts by weight of water and from 4 to 80 parts by weight of polymer having a number average molecular weight of less than 100,000, said polymer consisting essentially of recurring structural units of the formula

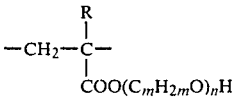

wherein R is H or $CH_3$, m is an integer of from 2 to 4, and n is an integer of from 2 to 20.

2. A water-based lubricant as claimed in claim 1 in which the number average molecular weight of said polymer is from 1,000 to 50,000.

3. A water-based lubricant as claimed in claim 1 or claim 2, also containing from zero to 50 parts by weight of a water-soluble organic solvent.

4. A water-based lubricant as claimed in claim 3, also containing an effective amount of one or more lubricant additives selected from the group consisting of an antiwear agent, a rust inhibitor, an antioxidant and an antifoaming agent.

5. A water-based lubricant as claimed in claim 3 consisting essentially of water, said polymer and said water-soluble organic solvent.

* * * * *

UNITED STATES PATENT AND TRADEMARK OFFICE

CERTIFICATE OF CORRECTION

PATENT NO. : 4,332,689

DATED : June 1, 1982

INVENTOR(S) : Yoshiharu Tanizaki et al

It is certified that error appears in the above-identified patent and that said Letters Patent is hereby corrected as shown below:

On the title page the name of the second inventor should read

-- Sigeyuki Takase --.

Signed and Sealed this

*Fifteenth* Day of *March 1983*

[SEAL]

*Attest:*

GERALD J. MOSSINGHOFF

*Attesting Officer*

*Commissioner of Patents and Trademarks*